US006308467B1

(12) United States Patent
Timilty

(10) Patent No.: US 6,308,467 B1
(45) Date of Patent: Oct. 30, 2001

(54) WALL POSITIONING AND BRACING APPARATUS AND METHOD

(76) Inventor: Joseph Francis Timilty, 30 Green Lodge St., Canton, MA (US) 02021

( * ) Notice: Subject to any disclaimer, the term of this patent is extended or adjusted under 35 U.S.C. 154(b) by 0 days.

(21) Appl. No.: 09/305,785

(22) Filed: May 4, 1999

(51) Int. Cl.[7] ..... E02D 35/00; E04G 21/14

(52) U.S. Cl. ..... 52/127.2; 52/127.1; 52/745.11; 52/745.12; 248/351

(58) Field of Search ..... 52/127.1, 127.2, 52/126.3, 745.09, 745.11, 745.12; 248/351

(56) References Cited

U.S. PATENT DOCUMENTS

| | | | | |
|---|---|---|---|---|
| 1,653,126 | * | 12/1927 | Schwerin | 248/351 |
| 3,574,981 | | 4/1971 | Henschen . | |
| 3,675,885 | * | 7/1972 | Shute | 248/351 |
| 3,700,202 | | 10/1972 | Donnels . | |
| 3,727,885 | | 4/1973 | Jones . | |
| 3,885,361 | | 5/1975 | De Schutter . | |
| 4,068,427 | * | 1/1978 | Camardo | 52/127.1 |
| 4,083,156 | * | 4/1978 | Tye | 52/127.1 |
| 4,872,634 | | 10/1989 | Gillaspy . | |
| 5,322,404 | | 6/1994 | Keller . | |
| 5,634,301 | * | 6/1997 | Koller | 52/127.2 |
| 5,938,391 | * | 8/1999 | Allen | 248/351 X |
| 5,943,830 | * | 8/1999 | Truitt | 52/127.2 |
| 6,029,407 | * | 2/2000 | Schilero, Jr. | 52/127.2 |

* cited by examiner

*Primary Examiner*—Beth A. Stephan
*Assistant Examiner*—Brian E. Glessner

(57) ABSTRACT

A wall positioning and bracing method is disclosed. The method comprises providing a device comprising first and second elongated members, each having proximal and distal ends, and being pivotally attached to one another at their proximal ends, such that the second elongated member is movable into an open position, coextensive with the first elongated member; affixing the device to the floor of a building under construction and to the upper end of a wall of a building under construction when the wall is lying flat on the floor of a building under construction; raising the wall so that the brace is in the open position and the first and second elongated members are coextensive, such that the wall is moved to a position perpendicular to the floor; and securing the members in the open position. The method permits a wall to be raised to and braced in a position perpendicular to the floor.

2 Claims, 12 Drawing Sheets

WALL POSITIONING AND BRACING APPARATUS AND METHOD

FIELD OF THE INVENTION

This invention is directed to the construction industry and, in particular, to the construction of houses wherein prefabricated building walls are raised and positioned perpendicularly to the floors of buildings.

BACKGROUND OF THE INVENTION

In the construction industry, individual homes generally are built from the ground up. First the foundation, then the ground floor, are constructed. Then, the walls must be built. One way of doing this is to prefabricate sections of wall, lay them on the floor, and raise them into position. Generally, this is done individually and sequentially. One section of wall is raised, and is placed in position by construction workers. The wall section must be exactly vertical, perpendicular to the floor. To ensure that the wall is at a 90° angle, the construction workers measure the position of the wall, and fix the wall in position by nailing struts to the wall and floor to hold the wall in place. After construction of the level is completed, the struts are removed.

This procedure requires the use of a number of nails which must then be removed, and requires several construction workers to raise, position, and brace a wall.

Those reasonably skilled in the art of construction currently use the method described above, whereby the wall is raised, positioned first by "eye" and refined by use of tools such as a plumb line, and retained in position with a series of "2-by-4s" nailed to the wall. A search for prior art yielded six references:

U.S. Pat. No. 5,332,404
U.S. Pat. No. 4,872,634
U.S. Pat. No. 3,885,361
U.S. Pat. No. 3,727,885
U.S. Pat. No. 3,700,202
U.S. Pat. No. 3,574,981

SUMMARY OF THE INVENTION

The present invention provides an apparatus and method for raising a wall to the perpendicular position and temporarily bracing the wall in that position during construction of buildings. In a first embodiment, the wall positioning and bracing apparatus of the present invention includes:

- first and second elongated members each having proximal and distal ends, and being pivotally attached to one another at their proximal ends;
- a connector plate affixed to the distal end of the first member for affixing to the floor of a building under construction;
- wall affixing means attached to the distal end of the second member for removably affixing the second member to the upper end of a prefabricated wall when said wall is initially lying flat on the floor with a base in a location desired for the wall when erected, such that the wall to which the second elongated member is attached may be moved to a position perpendicular to the floor, such position determined, among other things, by the combined length of the first and second members, the position where the connector plate is affixed to the floor, and the position on the wall where the second member is affixed.

In a related embodiment, there is provided a method whereby the apparatus of the present invention is used to raise and position a wall perpendicular to a floor during the construction of buildings. The method of this embodiment includes:

- providing an apparatus as described above;
- affixing the connector plate at the distal end of the first elongated member of claim 1 to the floor of a building under construction;
- affixing the distal end of the second elongated member of claim 1 to the upper end of a prefabricated wall;
- raising the wall to the point where the brace is opened to the open position wherein the first and second elongated members are coextensive, such that the wall is moved to a position perpendicular to the floor; and
- securing the members in the open position.

In a further embodiment of the apparatus herein, the elongated members are pivotally attached such that the second elongated member is moveable 180° into an open position coextensive with the first elongated member, and the apparatus further comprises a means for securing the apparatus in the open position.

Using an embodiment, a construction worker measures out from the edge of the floor to a certain distance, for example, 84 inches, and positions the distal end of the first elongated member at that point. The elongated member is affixed, for example, pivotally, to the floor at that point. A second elongated member is pivotally attached to the opposite end of the first elongated member, and folds such that the second elongated member lies parallel to and on top of the first elongated member. The distal end of the second elongated member may be affixed to the wall section. The brace is affixed to the wall at a point, for example, two inches vertically from the floor. When the brace is opened, and the wall is raised, components of the embodiment are dimensional so that when the brace is unfolded to the open, coextensive position, then the wall automatically is raised to a position perpendicular to the floor. The brace may be latched in the open position to hold the wall in the perpendicular position. A preferred latching method is by inserting pins through holes in a side-mount brace attached to the first elongated member which become aligned with holes in the second elongated member when the brace is opened. In a preferred embodiment, the elongated members are made of steel to ensure strength and durability.

For an example of suitable dimensions for the embodiment described immediately above, the length from the end of the first elongated member affixed to the floor to the end of the second elongated member affixed to the wall is 121.62 inches. Even more preferably, the first elongated member is 59.5 inches long and the second elongated member is 61.5 inches long, with a space for a hinge between them 0.62 inches long. These lengths are preferred because with standard-sized houses, 86 inches high is a preferred point of affixing the brace to the wall when the wall is positioned vertically. When the distal end of the first member is affixed to the floor 84 inches ($D_1$)from the edge of the floor, and the distal end of the second member is affixed 2 inches ($D_2$) vertically and 86 inches horizontally from the edge of the floor when the wall is lying on the floor, after the wall is raised, the total horizontal length from the point of affixation to the floor to the point of affixation to the wall is 86 inches. When the wall is in the vertical position, the 86 inch high point of affixation to the wall (H) and the 86 inch horizontal distance from the point of affixation on the floor to the point of affixation on the wall (D), ($D=D_1+D_2$), ensures that the wall will be perpendicular to the floor, when the total length of the brace from the point of affixation to the floor to the point of affixation to the wall (L) totals 121.62 inches ($H^2+D^2=L^2$: (horizontal distance: 86 inches)$^2$+(vertical distance: 84 inches ($D_1$)+2 inches ($D_2$))$_2$=(length from point of affixation to floor to point of affixation to wall: "L")$^2$=>L= 121.62 inches.

In this preferred embodiment, the point of affixation of the second elongated member to the wall is 2 inches longer than the point of affixation of the first elongated member to the floor in order to ensure that when the wall is vertical, the point of affixation to the wall is 86 inches high. This is so because the first elongated member is affixed to the floor at a point 84 inches from the edge of the floor, so to ensure that the point of affixation to the wall is an additional 2 inches beyond the edge of the floor when the brace is in the open position, the second elongated member is affixed to the wall in the horizontal position such that it is affixed 2 inches beyond the 84 inch point of measurement from the edge of the floor.

Rather than the current method of positioning the wall sections by "eye" and then measuring and repositioning, the present invention will increase accuracy by automatically positioning the wall perpendicular to the floor. In addition, use of the present invention will reduce the number of nails on the job site, and will promote safety and efficiency. Use of the present invention in a preferred embodiment also prevents "losing" the wall beyond the perpendicular position: when the wall is raised to the vertical position, the present invention may prevent the wall from moving past the perpendicular position. According to a common method of construction, after a wall is positioned, it is held in place by several "2-by-4s", which are nailed to the wall and to the floor. The "2-by-4s" hold the wall in place until construction of the level is complete and they no longer are necessary. They are then removed, resulting in time and effort in removing the nails and handling the "2-by-4s" and nails so as to pose a safety hazard on the job site. The present invention promotes both efficiency and safety. In a preferred embodiment, use of the present invention requires only 4 nails to affix the apparatus to the floor, 1 "spike" to connect the device to the wall before and during its positioning, and 4 nails for securing the apparatus to the wall when it is properly positioned. A plurality of these construction braces may be used when necessary, depending on the specifications of each construction project.

A preferred embodiment is constructed at the specified measurements for use in the construction of standard-sized houses.

One of the advantages of the present invention is its simplicity. It eliminates the need for plumbing and positioning the wall because when the wall is raised and the brace is unfolded to the open position, the wall is automatically positioned properly. The invention thus expedites the construction process and ensures accuracy in positioning walls.

DETAILED DESCRIPTION OF A PREFERRED EMBODIMENT

Figure 1:
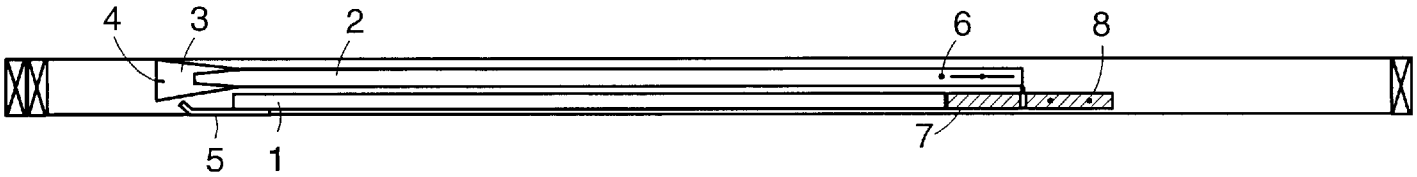
FIG. 1 is a perspective view of a preferred embodiment of the construction brace of the present invention, as viewed from the side of the present invention in the folded position.

As illustrated in FIG. 1, a preferred embodiment of the present invention has a first elongated member 1, which is pivotally attached 7 to a second elongated member 2, such that the second elongated member 2 may be folded and positioned horizontally on top of the first elongated number 1. As shown in FIG. 1, the first elongated member 1 may be attached to a connector plate 5. The second elongated member 2 may be attached to a top plate 3 having a spike hole 4 for spiking the device to a prefabricated wall section horizontally positioned on the floor adjacent to the present invention.

Figure 2:
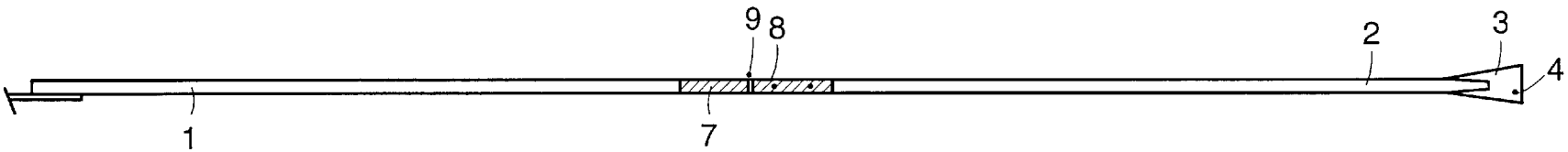
FIG. 2 is a perspective view of a preferred embodiment of the construction brace of the present invention, as viewed from the side of the present invention in the unfolded, open position.

FIG. 2 illustrates a preferred embodiment of the present invention in the open position. In FIG. 2, the second elongated member 2 is unfolded to the open position. As shown in FIG. 2, a preferred embodiment of the present invention has the first elongated member 1 having a length, for example, of 59.5 inches, with the second elongated member 2 having a length, for example, of 61.5 inches. When the apparatus is in the open position and connected to the floor and wall, a hinge 9 attaching the first elongated member 1 to the second elongated member 2 permits the apparatus to unfold to the open position, for example, with a gap of 0.62 inches between the two elongated members. The present invention may be latched in the open position for example, with a side-mount brace 7 having pin holes 8 to pin the side-mount brace 7 to the second elongated member 2. As shown in FIG. 1, the second elongated member may have pin holes 6 for receiving the pins through the side-mount brace 7 when the second elongated member 2 is in the open position.

Figure 3:
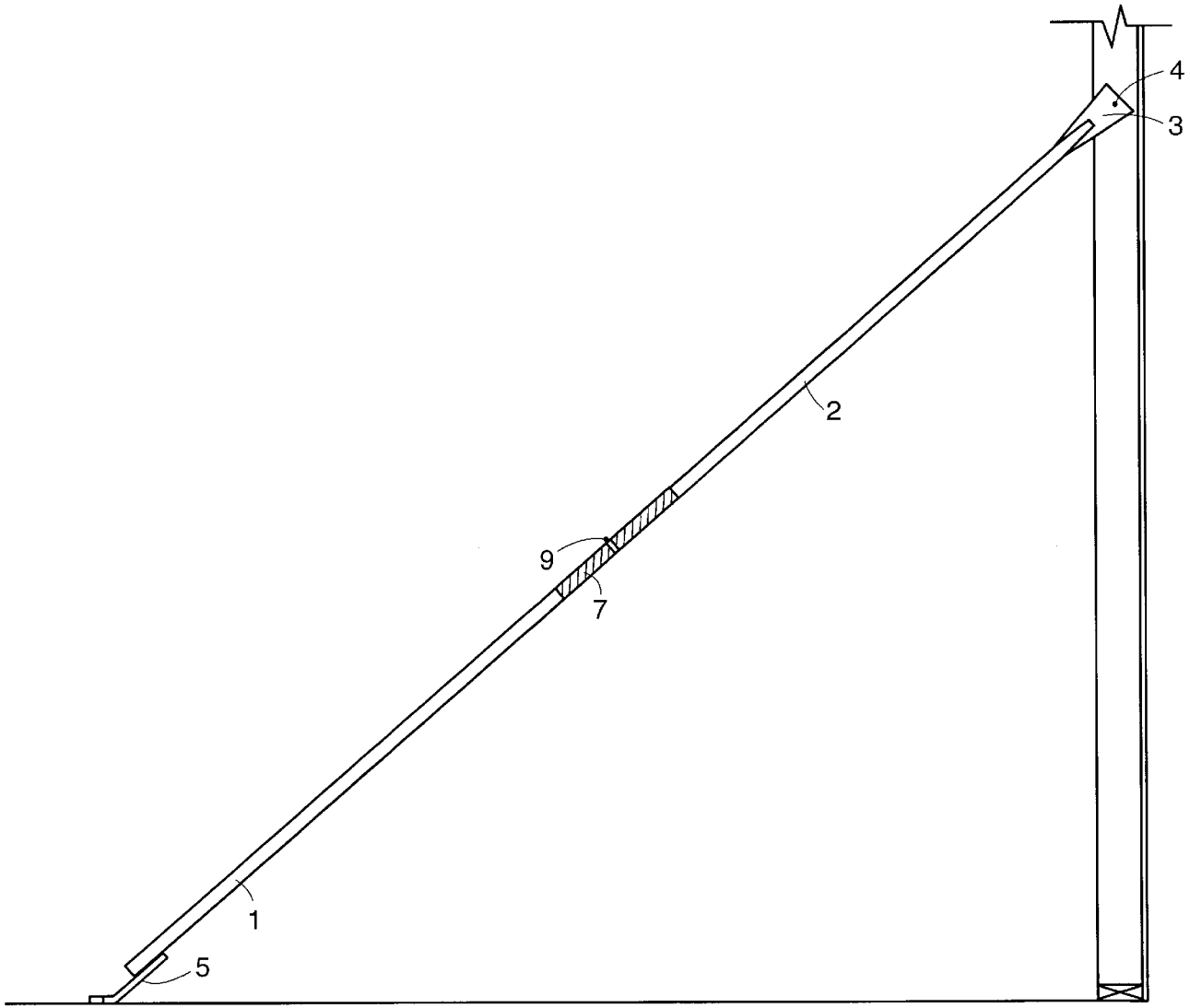
FIG. 3 is a perspective view of a preferred embodiment of the present invention, as viewed from the side of the construction brace of the present invention in the open position.

FIG. 3 illustrates a preferred embodiment of the present invention in the open position. As shown in FIG. 3, when the brace is in the open position, the wall is perpendicular to the floor, with the top plate 3 attached to the second elongated member 2 being spiked to the wall through the spike hole 4 in the top plate 3. The first elongated member 1 is attached to the connector plate 5, which may be positioned at a preferred distance from the point of attachment to the floor through nail holes 10 to the edge of the floor, for example, 84 inches.

Figure 4:
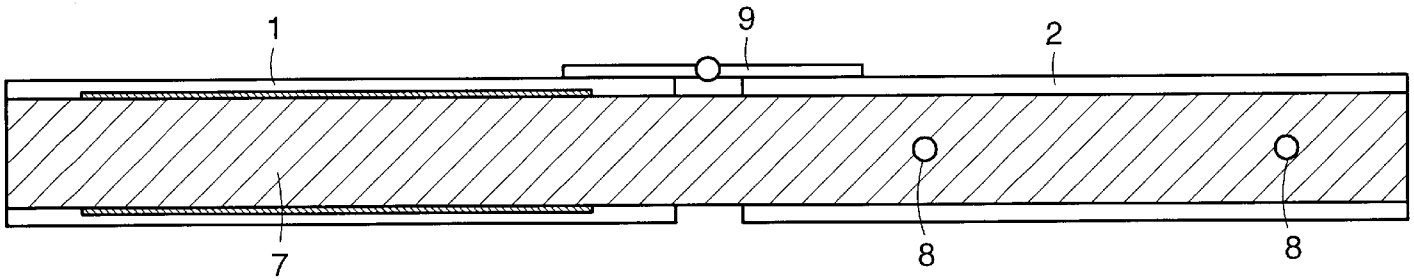
FIG. 4 is a perspective view of the side-mount brace of the construction brace of FIG. 2, as viewed from the side in the open position.

FIG. 4 illustrates a preferred embodiment of a latch, side-mount brace 7, securing the second elongated member 2 in the open position. In a preferred embodiment of the present invention, the first elongated member 1 is affixed to a latch, including a hinge 9, which is affixed to the second elongated member 2. When the brace is open, holes in the second elongated member 2, as shown in FIG. 1, are aligned with pin holes 8 in the side-mount brace, and secured by means of pins.

Figure 5:
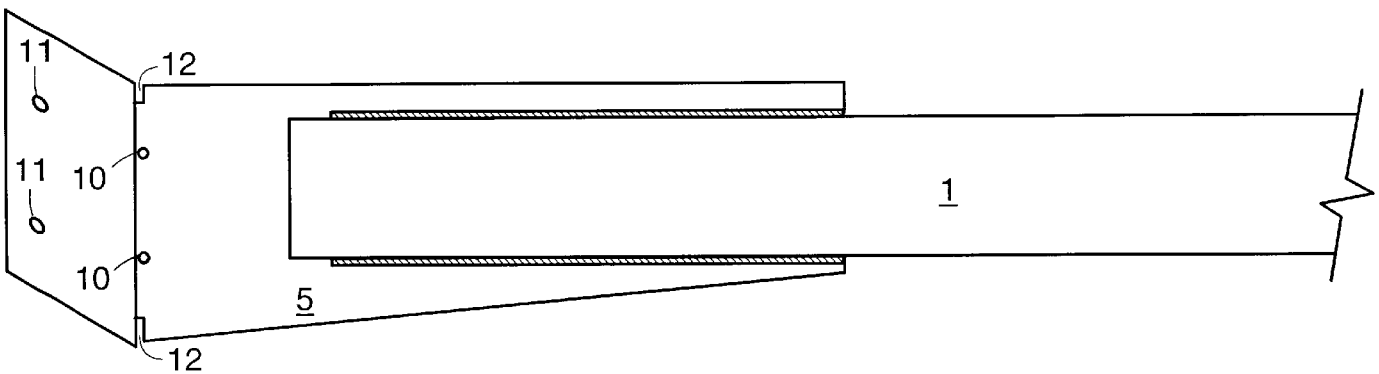
FIG. 5 is a perspective view of the base plate and connector plate of the construction brace of FIG. 3, as viewed from underneath the base plate and connector plate, with the connector plate bent at a 45° angle.

FIG. 5 illustrates a preferred embodiment of a connector plate for affixing the first elongated member 1 to the floor. The first elongated member 1 is attached to a connector plate 5, having nail holes 10 for securing the device to the floor. The device may be aligned at a desired distance from the edge of the floor, for example, 84 inches, by means of sight slots 13 and may be nailed to the floor at a desired distance, for example, 84 inches through the nail holes 10. The connector plate 5 has nail holes 11 for further securing the device to the floor. When the apparatus is open, the nail holes 10 and 11 in the connector plate 5 hold the apparatus in position attached to the floor. When the apparatus is open, the connector plate 5 pivots to the point where the first elongated member is positioned at an angle of 45° from the floor. FIG. 5 illustrates the connector plate in the raised position when the apparatus is in the open position.

Figure 6:
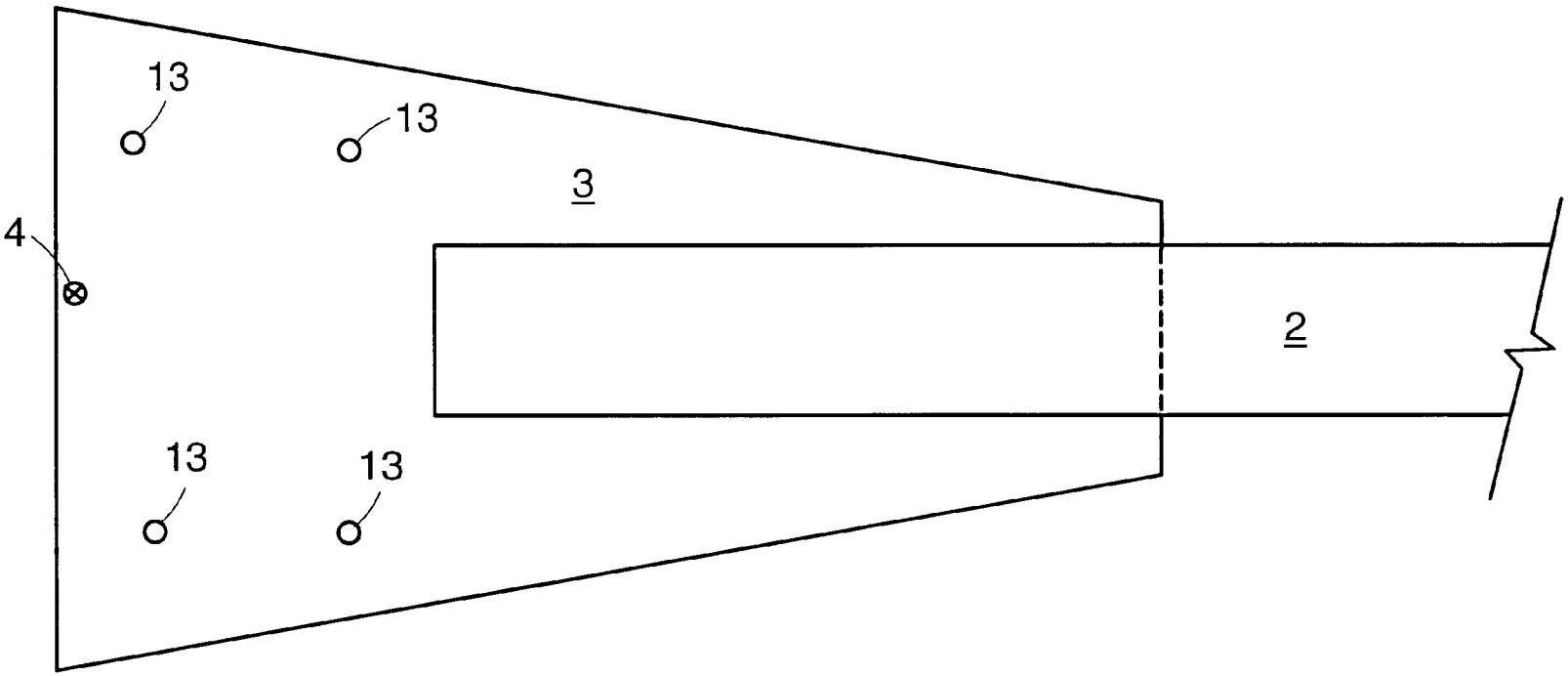
FIG. 6 is a perspective view of the top plate of the construction brace of FIG. 3, as viewed from the side of the top plate.

FIG. 6 illustrates a preferred embodiment of the present invention, wherein a top plate 3 is attached to the second elongated member 2. The top plate 3 has a spike hole 4 for spiking the apparatus to the side of a wall section. When the present invention is in the folded position next to the wall section as shown in FIG. 1, the top plate may be spiked to the wall at a distance of 2 inches vertically from the floor and at a distance 2 inches horizontally from the point where the connector plate is attached to the floor (for example, 84 inches from the edges of the floor) through the nail holes 10 and by means of the site slot 12 as shown in FIG. 5. Thus, the top plate may be spiked to the wall, for example, 86 inches horizontally from the edge of the floor. FIG. 6 also shows nail holes 13 in the top plate so that the top plate may be more rigidly secured to the wall section when the wall is elevated to the perpendicular position and the present invention is in the open position as shown in FIG. 3. The spike hole 4 allows the present invention to be pivotally moved into the open position while attached to the wall.

Figure 7:
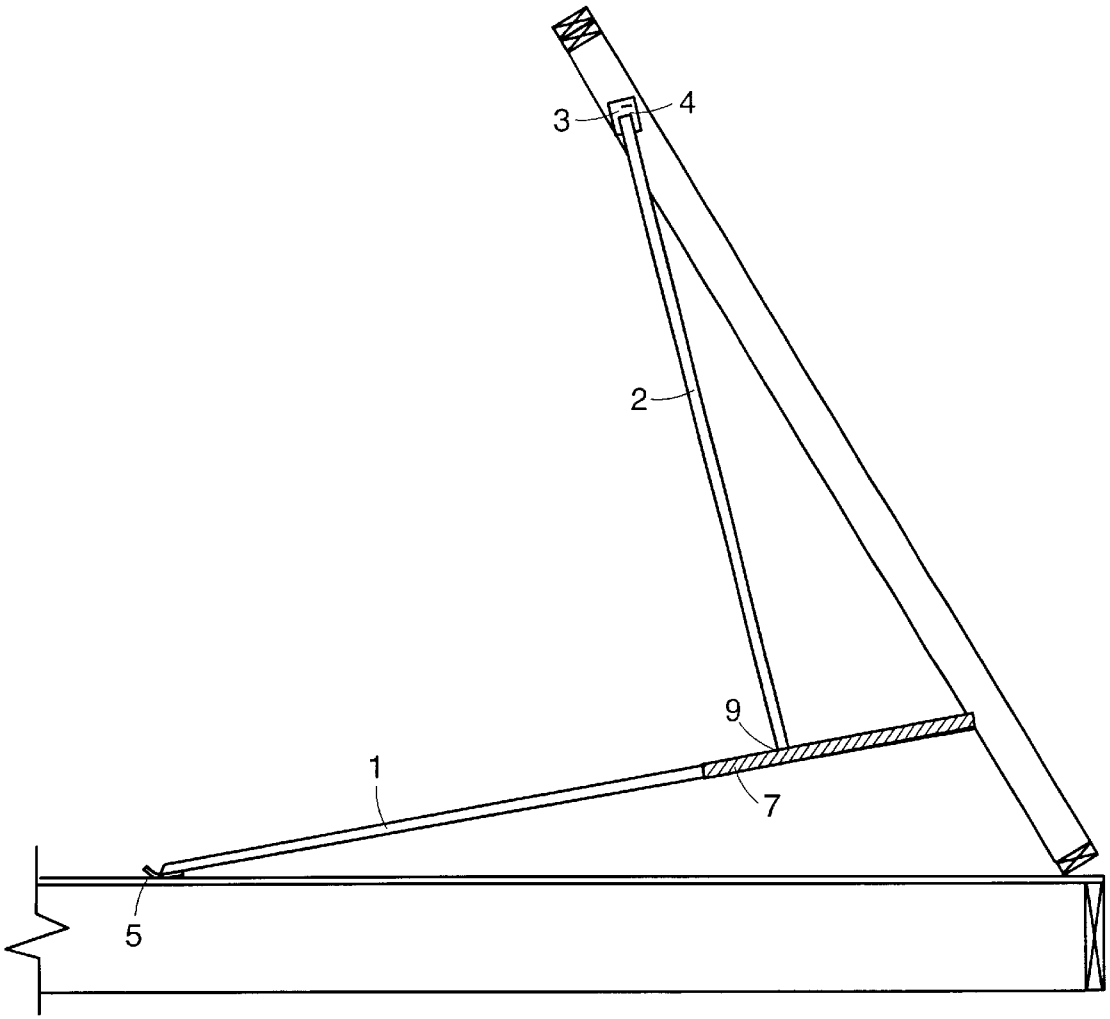
FIG. 7 is a perspective view of the construction brace of FIG. 3, as viewed from the side in the partially open position.

FIG. 7 illustrates a preferred embodiment of the present invention in a partially open position. As shown in FIG. 7, the top plate 3 may be movably affixed to the wall. As the wall is raised, the brace unfolds such that the second elongated member 2 moves from the horizontal position on top of the first elongated member 1 into the open position when the wall is perpendicular to the floor.

Figure 8:
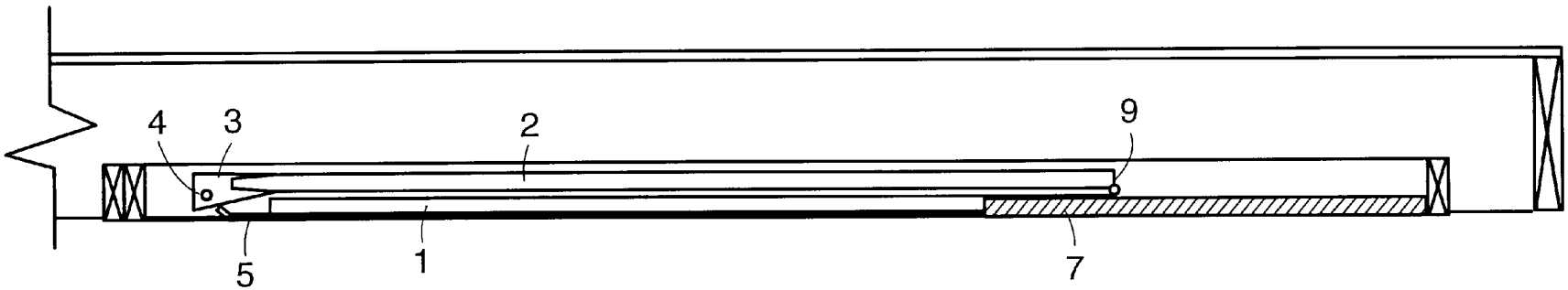
FIG. 8 is a perspective view of the construction brace of FIG. 1, as viewed from the side in the folded position.

FIG. 8 illustrates a preferred embodiment of the present invention in the folded position.

Figure 9:
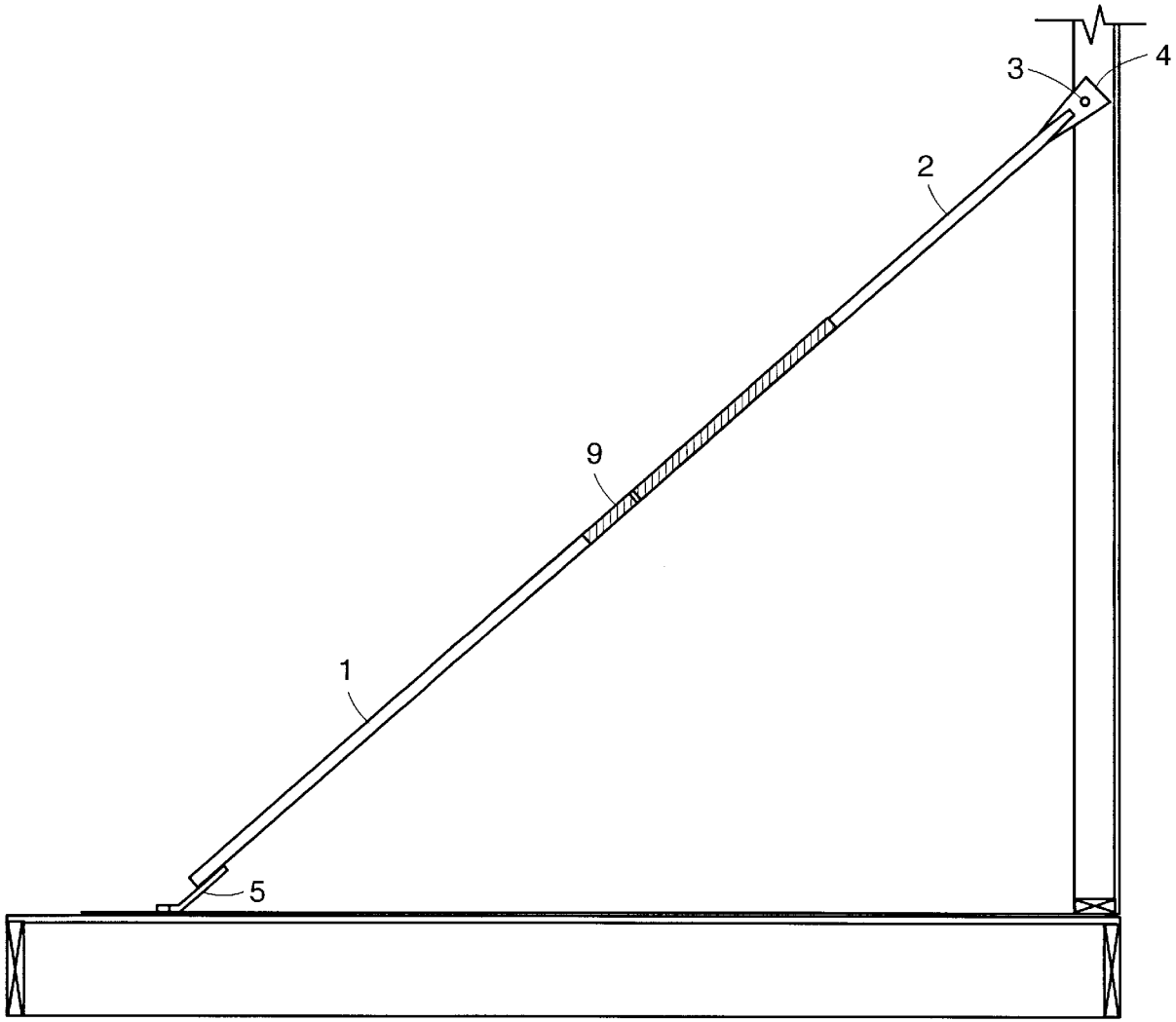
FIG. 9 is a perspective view of the construction brace of FIG. 3, as viewed from the side in the open position.

FIG. 9 illustrates a preferred embodiment of the present invention in the open position.

Figure 10:
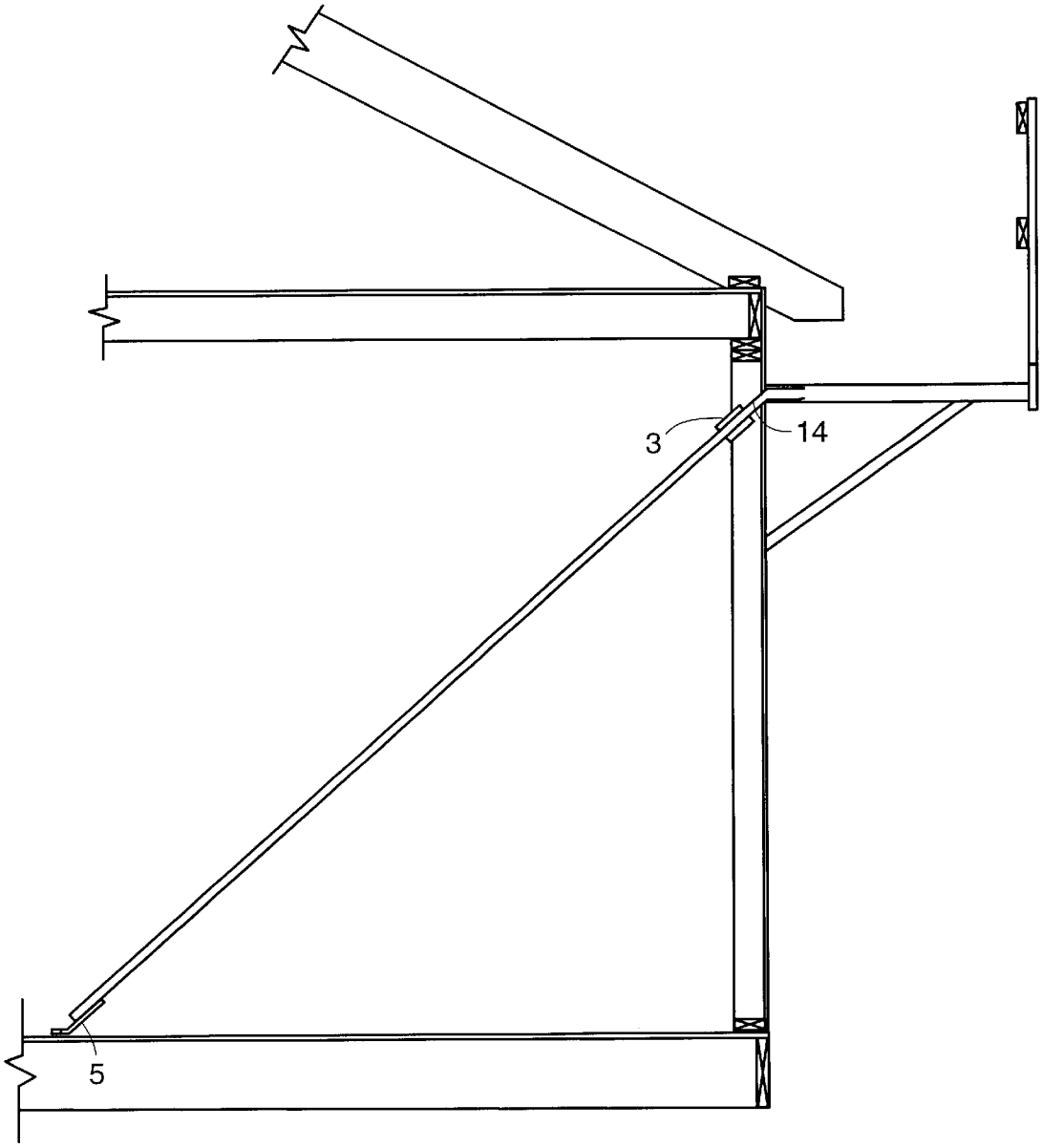
FIG. 10 is a perspective view of the construction brace of FIG. 3, also having a connector for affixing an apparatus at the end of the second elongated member.

FIG. 10 illustrates a preferred embodiment of the present invention wherein the second elongated member 2 is attached to a further elongated member 14 which continues beyond the wall and allows for attachment of various construction features, such as platforms or guard rails, to the apparatus.

Figure 11:
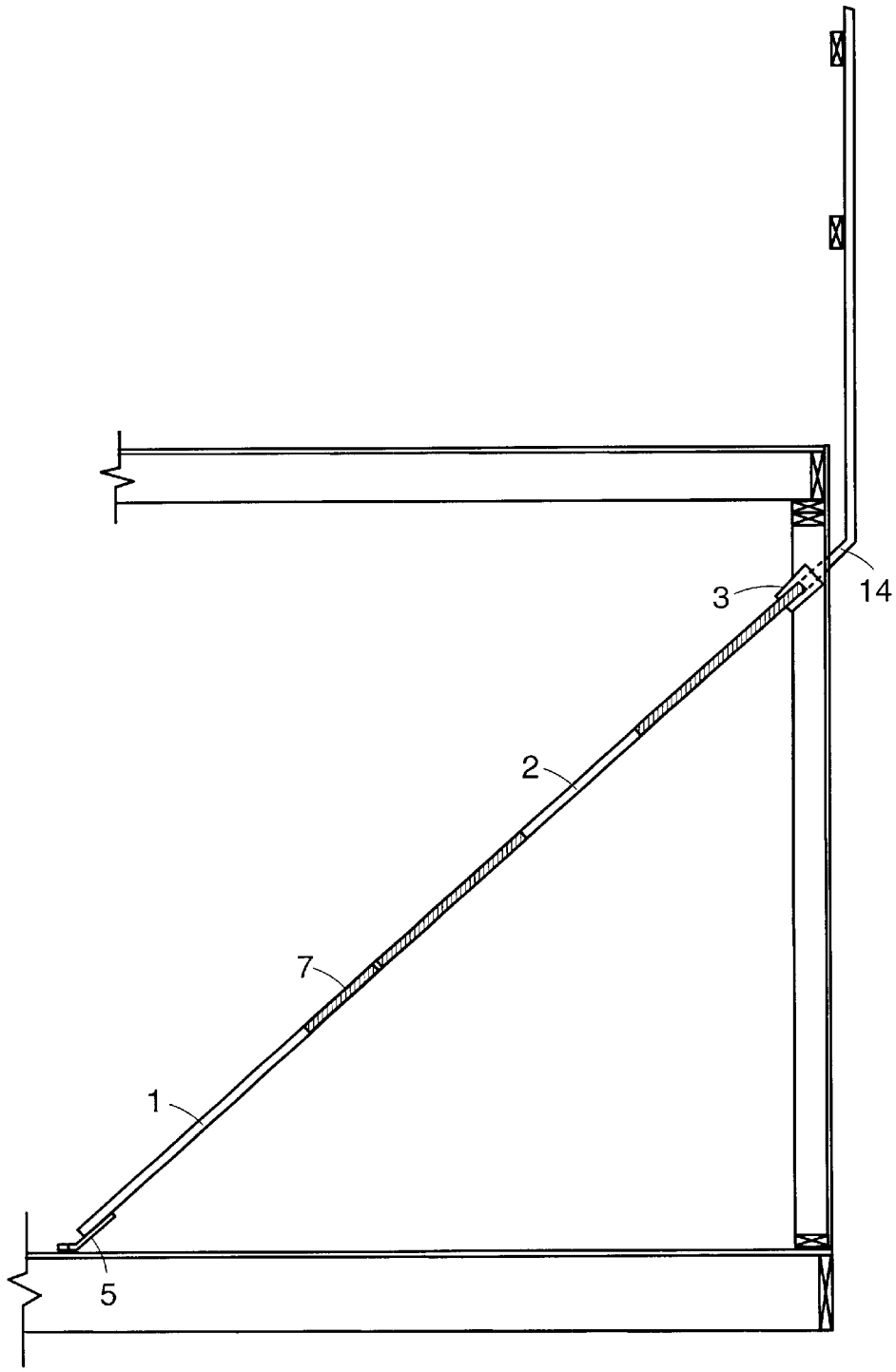
FIG. 11 is a perspective view of the construction brace of FIG. 3, also having a connector for affixing an apparatus at the end of the second elongated member.

FIG. 11 illustrates an embodiment of the present invention wherein the second elongated member 2 is attached to a further elongated member 14 which continues beyond the wall and allows for attachment of various construction features, such as platforms or guard rails, to the apparatus.

Figure 12:
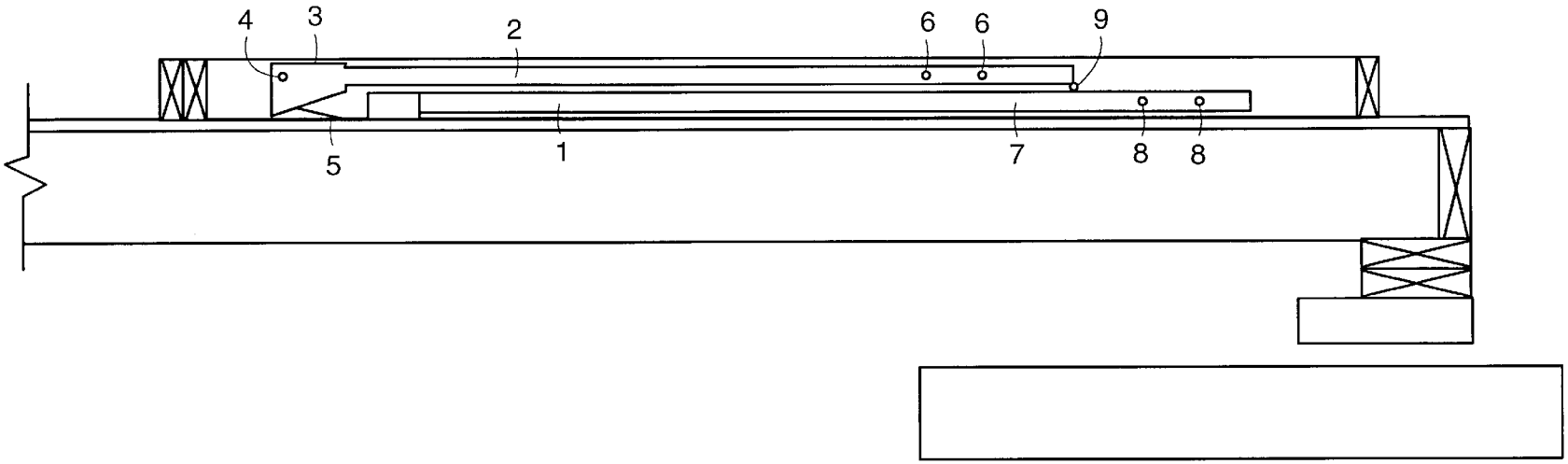
FIG. 12 illustrates a preferred embodiment of the present invention in the folded position.

FIG. 12 illustrates a preferred embodiment of the present invention in the folded position.

Figure 13:
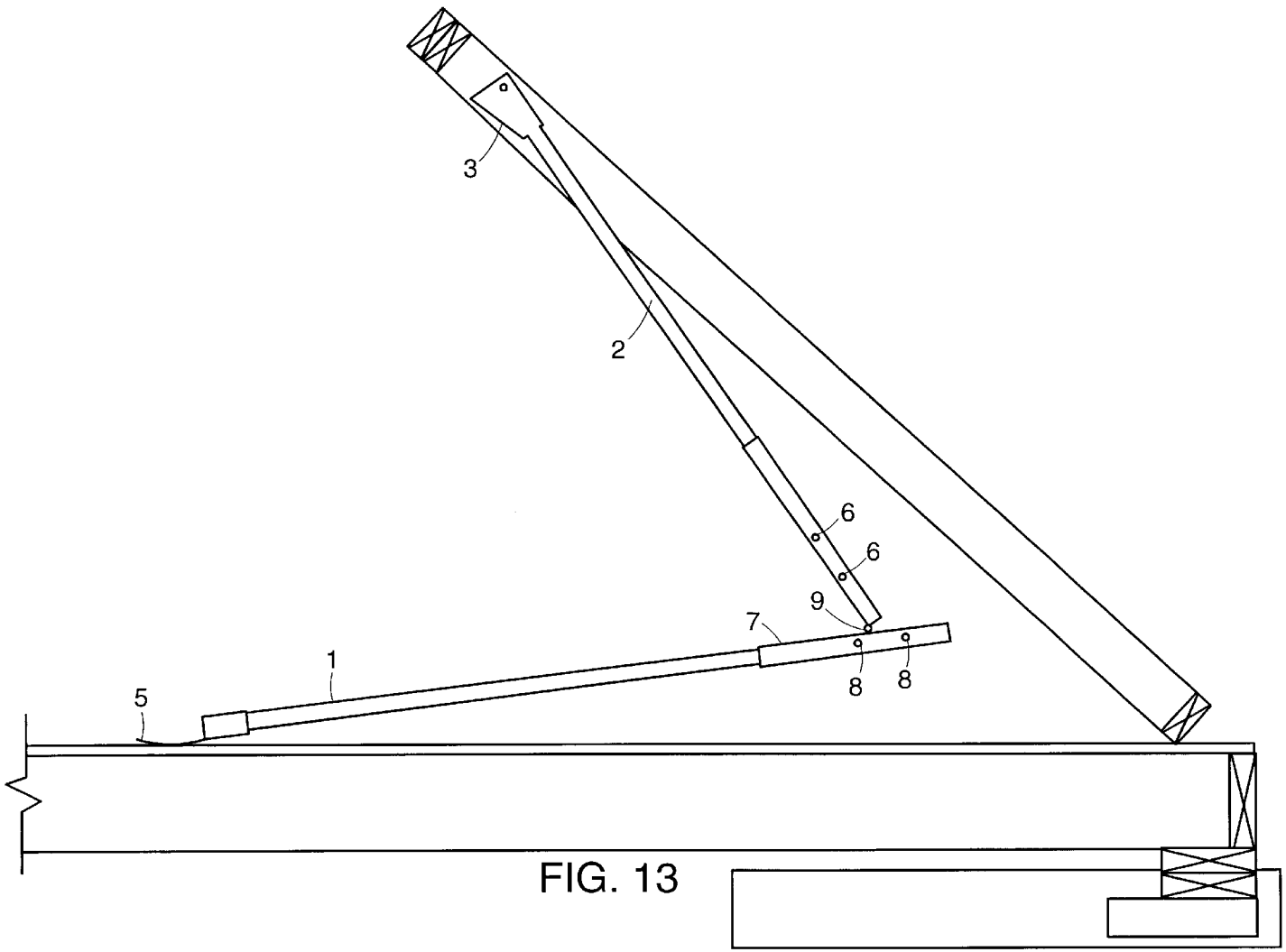
FIG. 13 illustrates a preferred embodiment of the present invention in the partially open position.

FIG. 13 illustrates a preferred embodiment of the present invention in the partially open position.

Figure 14:
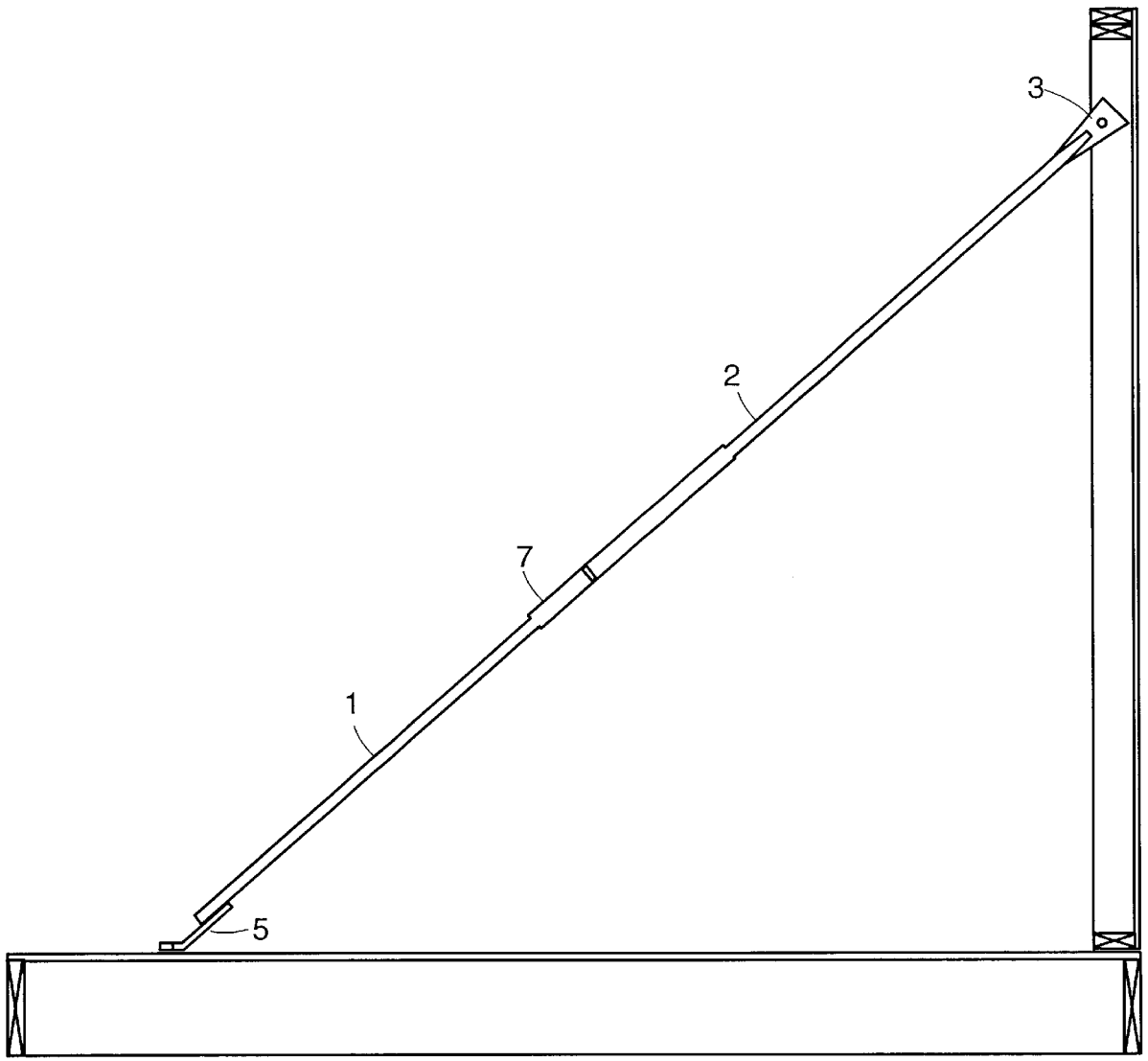
FIG. 14 illustrates a preferred embodiment of the present invention in the open position.

FIG. 14 illustrates a preferred embodiment of the present invention in the open position.

VARIATIONS OF DESIGN

Instead of designing the present invention according to the dimensions as described above, other dimensions could be used, as long as the wall is positioned perpendicular to the floor when the brace is opened.

Also, the present invention could be designed with a different hinge mechanism, for example, one that automatically locks when it reaches the open position, or with a different (or no) space between the first and second elongated members when the brace is opened. The present invention also could be designed with a side bracket of a given preferred length (e.g., 84 inches) such that the present invention could be positioned without measurement from the edge of the floor.

The present invention also could continue beyond the wall (as long as it is affixed to the wall so as to achieve the desired angle), in such a form so as to allow various construction features to be attached to the brace, such as, e.g., a work platform or guard rails for work on an upper floor. The present invention could also be designed with an extend or to allow the wall to move beyond the perpendicular position.

While this and other embodiments easily could be developed, the inventor has chosen the preferred embodiment as described because of the simplicity of use, and because of the small number of parts and simplicity of construction.

While the present invention has been described in detail, including preferred embodiments, an individual reasonably skilled in the art of construction could make variations and/or improvements to the present invention as described herein which may be within the scope of the invention as set forth in the following claims.

I claim:

1. A method for erecting a wall, comprising:

a. providing an apparatus comprising:

i. first and second elongated members each having proximal and distal ends, and being pivotally attached to one another at their proximal ends;

ii. a connector plate affixed to the distal end of the first member for affixing to the floor of a building under construction;

iii. wall affixing means attached to the distal end of the second member for removably affixing the second member to the upper end of a prefabricated wall when said wall is initially lying flat on the floor with a base in a location desired for the wall when erected; wherein the second elongated member is adapted to be attached to a wall which may be moved to a position perpendicular to the floor, such position determined, among other things, by the combined length of the first and second members, the position where the connector plate is affixed to the floor, and the position on the wall where the second member is affixed;

b. affixing the connector plate at the distal end of the first elongated member to the floor of a building under construction;

c. affixing the distal end of the second elongated member to the upper end of a prefabricated wall;

d. raising the wall to the point where the brace is opened to the open position wherein the first and second elongated members are coextensive, such that the wall is moved to a position perpendicular to the floor; and c. securing the members in the open position.

2. A method for erecting a wall as in claims 1, wherein the distance from the base of the wall at the edge of the floor to the point where the connector plate is affixed to the floor ($D_1$), the distance from the floor to the point where the second elongated member is affixed to the wall when the apparatus is in the closed position ($D_2$), the distance from the base of the wall to the point where the second elongated member is affixed to the wall (H), and the distance from the point where the connector plate is affixed to the floor to the point where the second elongated member is affixed to the wall when the apparatus is in the open position (L), have the following relationship: $(D_1+D_2)^2+H^2=L^2$, so that a wall of a building under construction may be raised to a position perpendicular to the floor when the apparatus is in the open position.

* * * * *